US006853285B2

(12) United States Patent
Kondo

(10) Patent No.: US 6,853,285 B2
(45) Date of Patent: Feb. 8, 2005

(54) INDUCTOR COMPONENT

(75) Inventor: Masahiro Kondo, Sendai (JP)

(73) Assignee: NEC Tokin Corporation, Sendai (JP)

( * ) Notice: Subject to any disclaimer, the term of this patent is extended or adjusted under 35 U.S.C. 154(b) by 151 days.

(21) Appl. No.: 10/053,596

(22) Filed: Jan. 22, 2002

(65) Prior Publication Data

US 2002/0097131 A1 Jul. 25, 2002

(30) Foreign Application Priority Data

Jan. 22, 2001 (JP) ..... 2001-012731

(51) Int. Cl.[7] ..... H01F 21/00

(52) U.S. Cl. ..... 336/110; 336/83; 336/178; 336/233

(58) Field of Search ..... 336/83, 110, 178, 336/212, 214, 215, 216, 217, 233, 234; 428/694 B, 694 BA, 900, 928

(56) References Cited

U.S. PATENT DOCUMENTS 2,774,935 A 12/1956 Rademakers et al.
3,631,534 A 12/1971 Hirota et al.
5,685,065 A 11/1997 Suzuki et al.

FOREIGN PATENT DOCUMENTS

EP 0 744 757 A1 11/1996
EP 0 938 106 A1 8/1999
JP 11-354344 * 12/1999

OTHER PUBLICATIONS

Patent Abstracts of Japan, vol. 007, No. 264 (E–212), Nov. 24, 1983 and JP 58–147011 A (Matsushita Denki Sangyo KK), Sep. 1, 1983—Abstract only.
Patent Abstracts of Japan, vol. 007, No. 284 (E–217), Dec. 17, 1983 and JP 58–162014 A (Matsushita Denki Sangyo KK), Sep. 26, 1983—Abstract only.

* cited by examiner

*Primary Examiner*—Tuyen T. Nguyen
(74) *Attorney, Agent, or Firm*—Frishauf, Holtz, Goodman & Chick, P.C.

(57) ABSTRACT

An inductor component is provided. The inductor component includes a core composed of a hollow core piece and a rod core piece, a bobbin, and bonded magnets. Regarding the hollow core piece and rod core piece, the rod core piece is arranged across the hollow core piece, and joining is performed between the bottom surfaces of both end portions of the rod core piece and the hollow core piece with bonded magnets therebetween.

3 Claims, 6 Drawing Sheets

INDUCTOR COMPONENT

BACKGROUND OF THE INVENTION

The present invention relates to an inductor component produced by inserting a magnet into a gap of a magnetic core. In particular, the present invention relates to an inductor component used for various electronic apparatuses, switching power supplies, etc.

Hitherto, an inductor component used for switching power supplies, etc., has been constituted by inserting a bonded magnet 42 into a gap of a trans EE type magnetic core 41, as shown in FIG. 1A. Herein, variations occur to some extent in width 44 of a magnetic gap shown in FIG. 1B. Furthermore, variations occur to some extent in thickness 45 of the bonded magnet 42 due to surface asperities of the magnet. Therefore, sufficient clearance 46 is ensured in order to avoid the bonded magnet 42 from becoming impractical to insert into the magnetic gap of the trans EE type magnetic core 41.

However, regarding the aforementioned conventional inductor component, this clearance becomes a magnetic reluctance, and becomes an obstacle to getting the best of bias effect. That is, when the bonded magnet is inserted into the magnetic gap of the trans EE type magnetic core, sufficient clearance must be ensured. Consequently, a problem of reduction in bias effect may occur due to insertion of a magnet having a thickness smaller than the width of the gap.

SUMMARY OF THE INVENTION

Accordingly, it is an object of the present invention to provide an inductor component capable of getting the best of bias effect without consideration of ensuring clearance.

According to an aspect of the present invention, an inductor component including a core is provided. In the aforementioned core, a rod core piece is arranged across a hollow core piece, and joining is performed between the hollow core piece and the bottom surfaces of both end portions of the rod core piece with bonded magnets therebetween.

According to another aspect of the present invention, an inductor component including another core is provided. The aforementioned core includes a hollow core piece having two concave portions and a rod core piece. The rod core piece is arranged across the hollow core piece, and joining is performed between the bottom surfaces of both end portions of the rod core piece and the respective concave portions of the hollow core piece with bonded magnets therebetween.

According to another aspect of the present invention, an inductor component including another core is provided. The aforementioned core includes an upper hollow core piece, a lower hollow core piece, and a rod core piece. The rod core piece is held between the upper and lower hollow core pieces and is arranged across each of the hollow core pieces. Joining is performed between the top surfaces of both end portions of the rod core piece and the upper hollow core piece with bonded magnets therebetween. Joining is performed between the bottom surfaces of both end portions of the rod core piece and the lower hollow core piece with bonded magnets therebetween.

According to the present invention, the best of bias effect can be exhibited by inserting a bonded magnet having a thickness equivalent to the width of the gap.

As described above, since the bonded magnet is inserted into the joint portion of the aforementioned hollow core piece and the aforementioned rod core piece, the thickness of the magnet becomes the width of the gap and, therefore, the magnet having a thickness equivalent to the width of the gap can be inserted. That is, the best of bias effect can be exhibited without consideration of the clearance.

DESCRIPTION OF THE PREFERRED EMBODIMENTS

Figure 1A:
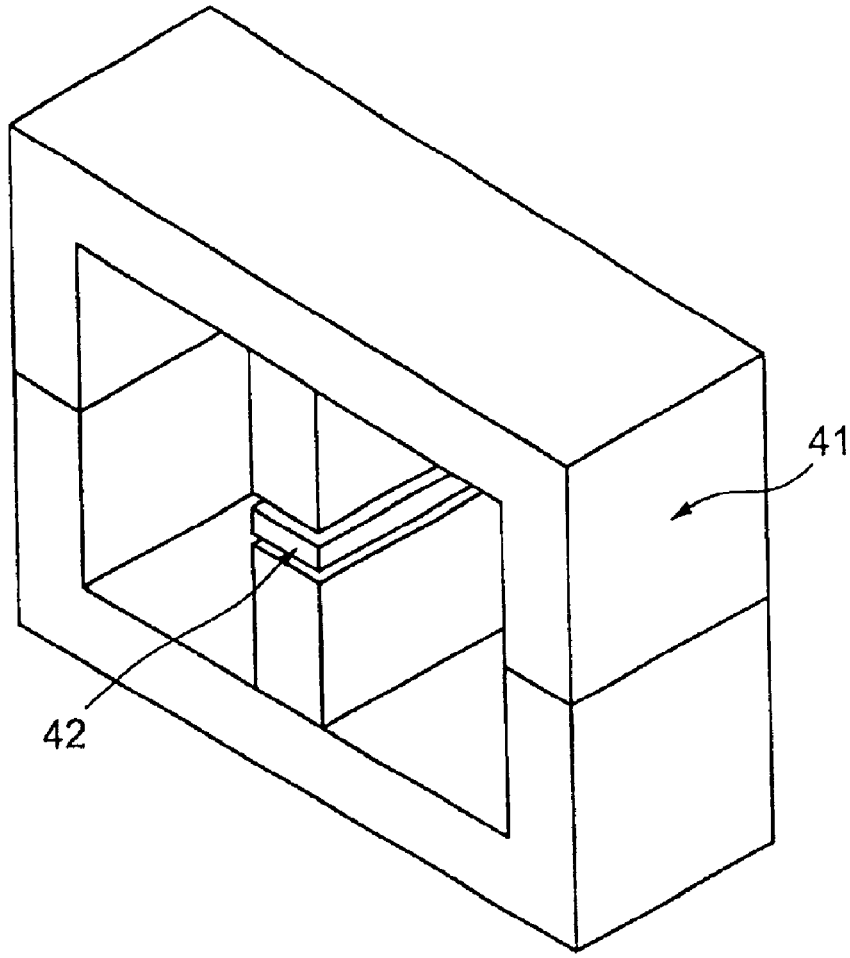
FIG. 1A PRIOR ART
FIG. 1A is a perspective view of the whole according to a conventional technique.
Figure 1B:
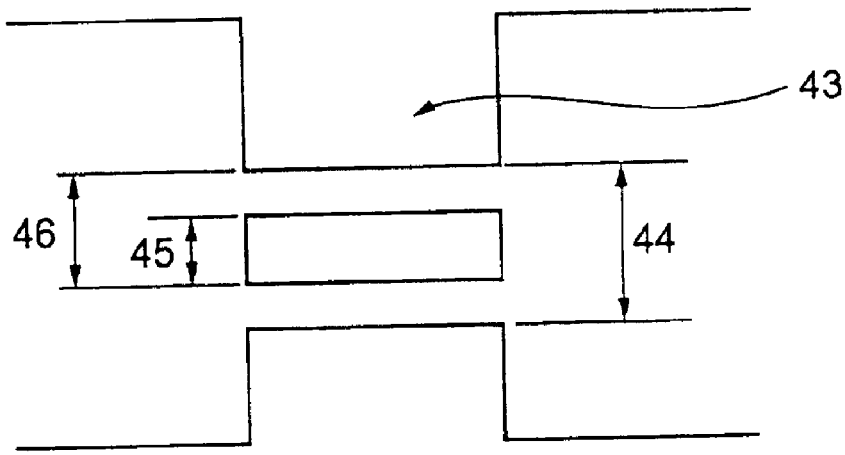
FIG. 1B PRIOR ART
FIG. 1B is an enlarged diagram of a gap portion according to the conventional technique.
Figure 2A:
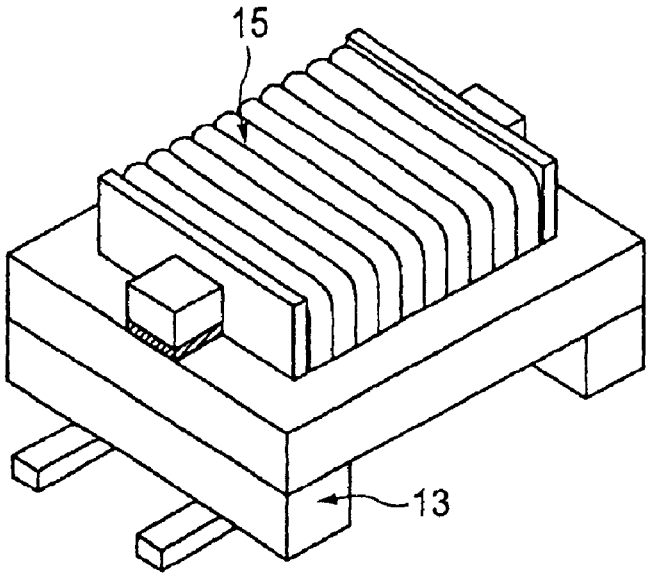
FIG. 2A is a perspective view of the whole according to a first embodiment of the present invention.
Figure 2B:
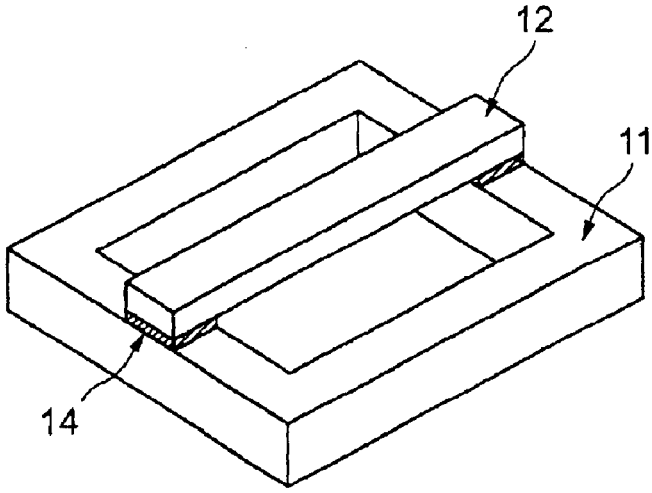
FIG. 2B is a perspective view of a core portion assembled according to the first embodiment of the present invention.
Figure 2C:
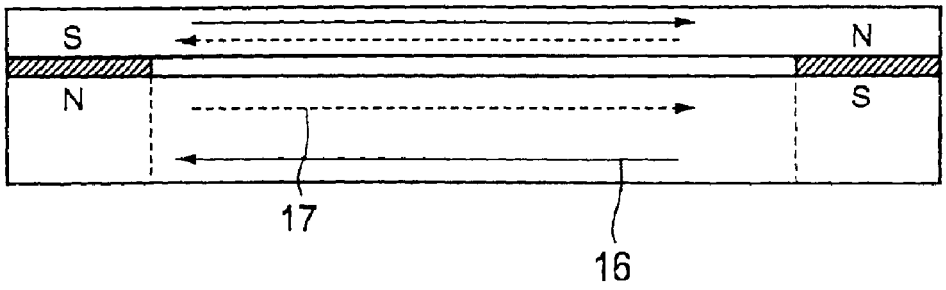
FIG. 2C is a side view of only the core portion shown in FIG. 2B.

An inductor component according to a first embodiment of the present invention will be described below in detail with reference to FIGS. 2A to 2C and 5. FIGS. 2A to 2C show the configuration of the inductor component according to the first embodiment of the present invention. FIG. 2A is a perspective view of an assembly completed. FIG. 2B is a perspective view showing only a hollow core piece and a rod core piece. FIG. 2C is a sectional view of FIG. 2B and shows the directions of lines of magnetic flux generated by a magnetic field due to a coil and magnetic fields due to bonded magnets.

The inductor component includes a core composed of a hollow core piece 11 and a rod core piece 12, a bobbin 13, and bonded magnets 14. Regarding the hollow core piece 11 and rod core piece 12, the rod core piece is arranged across the hollow core piece, and joining is performed between the bottom surfaces of both end portions of the rod core piece 12 and the hollow core piece 11 with bonded magnets 14 therebetween. The coil 15 is arranged as shown in FIG. 2A. The assembly assembled as described above is used as an inductor component.

Herein, as shown in FIG. 2C, the magnetic flux generated by the magnetic field due to the coil flows in the direction indicated by solid line arrows (reference numeral 16). The magnetic flux generated by the magnetic fields due to the bonded magnets flow in the direction indicated by broken line arrows (reference numeral 17).

Mn—Zn ferrite is used as the material for the hollow core piece 11 and rod core piece 12 used in the present embodiment. The magnetic path length is 6.0 cm, and the effective cross-sectional area is 0.1 $cm^2$. The bonded magnets 14 have a shape of 250 $\mu$m in thickness and 0.1 $cm^2$ in cross-sectional area. SmCo is used as the material powder.

Figure 5:
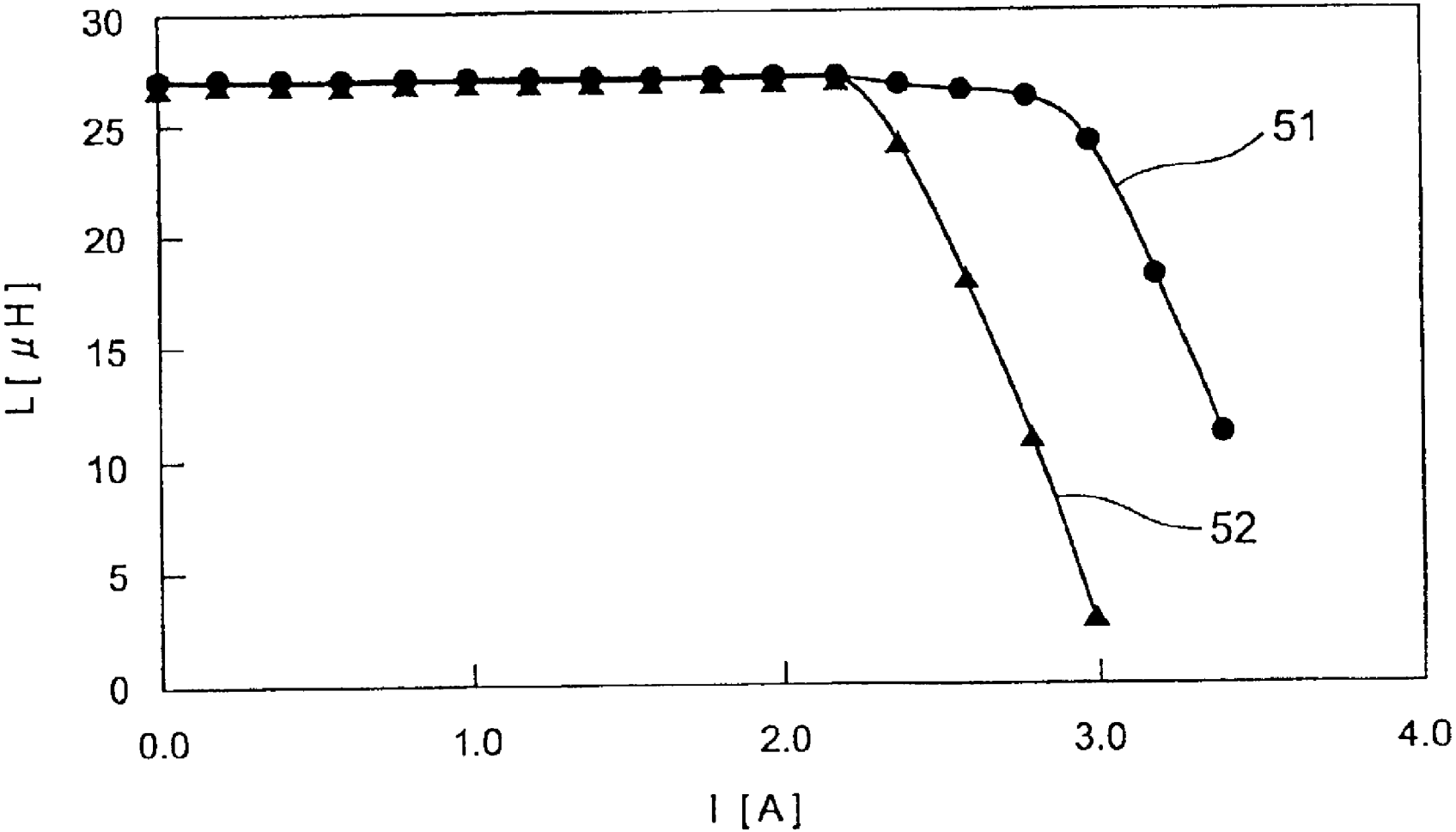
FIG. 5 is a diagram showing the measurement results of the direct current superimposition in the first embodiment.

The coil 15 has 18 turns and has a direct current resistance of 500 mΩ. The bonded magnets 14 are arranged at two places where the hollow core piece 11 and the rod core piece 12 are in contact with each other. The bonded magnet 14 is arranged in order that the direction of the magnetic flux generated by the magnetic field due to the magnet is opposite to the direction of the magnetic flux generated by the magnetic field due to the coil 15. FIG. 5 shows the measurement results of the direct current superimposition.

In FIG. 5, a solid line 51 indicates the case where the bonded magnet 14 is inserted, and a solid line 52 indicates the case where the bonded magnet 14 is not inserted. As is clear from these results, the direct current superimposition is improved by about 35% due to the bonded magnet 14.

Figure 3A:
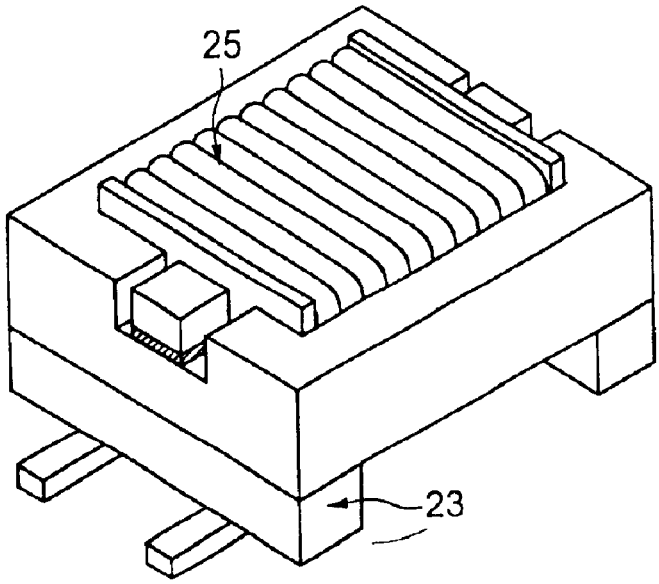
FIG. 3A is a perspective view of the whole according to a second embodiment of the present invention.
Figure 3B:
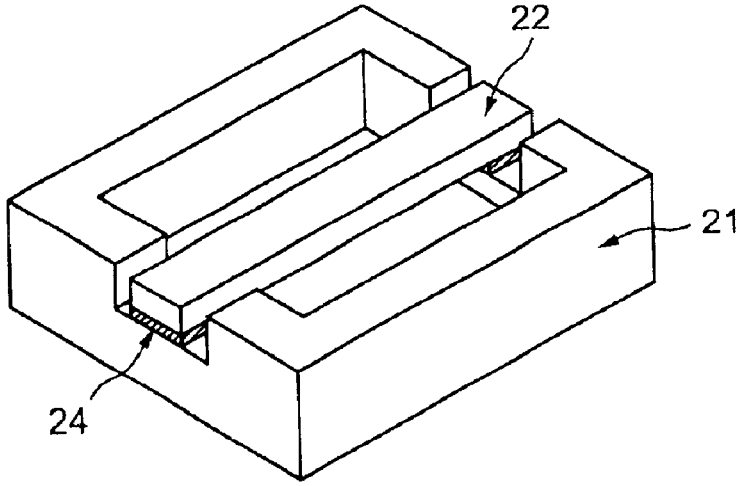
FIG. 3B is a perspective view of a core portion assembled according to the second embodiment of the present invention.
Figure 3C:
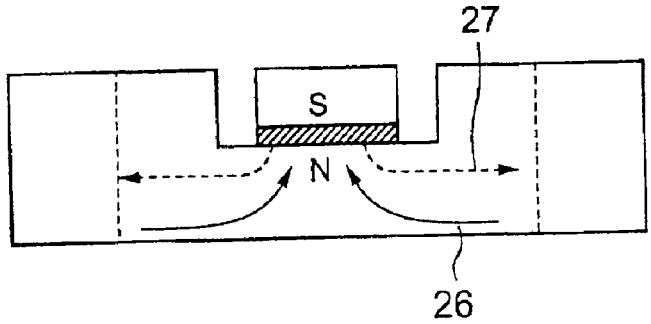
FIG. 3C is a front view of only the core portion shown in FIG. 3B.

An inductor component according to a second embodiment of the present invention will be described below in detail with reference to FIGS. 3A to 3C and 6. FIGS. 3A to 3C show the configuration of the inductor component according to the second embodiment of the present invention. FIG. 3A is a perspective view of an assembly completed. FIG. 3B is a perspective view showing only a hollow core piece and a rod core piece. FIG. 3C is a sectional view of FIG. 3B and shows a magnetic field due to the coil and a magnetic field due to the bonded magnet.

The inductor component includes a core composed of a hollow core piece 21 and a rod core piece 22, a bobbin 23, and bonded magnets 24, and is eventually assembled as shown in FIG. 3A. The coil 25 is arranged as shown in FIG. 3A. As shown in FIG. 3B, the hollow core piece 21 has concave portions provided at the places where the hollow core piece 21 and the rod core piece 22 are in contact with each other. As shown in FIGS. 3B and 3C, the bonded magnets 24 are inserted into two places of both end portions of the rod core piece where joining is performed between the hollow core piece 21 and the rod core piece 22. The assembly assembled as described above is used as an inductor component.

Herein, as shown in FIG. 3C, the magnetic flux generated by the magnetic field due to the coil flows in the direction indicated by solid line arrows (reference numeral 26). The magnetic flux generated by the magnetic fields due to the bonded magnets flow in the direction indicated by broken line arrows (reference numeral 27).

Mn—Zn ferrite is used as the material for the hollow core piece 21 and rod core piece 22 used in the present embodiment. The magnetic path length is 6.0 cm, and the effective cross-sectional area is 0.1 $cm^2$. The bonded magnets 24 have a shape of 250 $\mu$m in thickness and 0.1 $cm^2$ in cross-sectional area. SmCo is used as the material powder.

Figure 6:
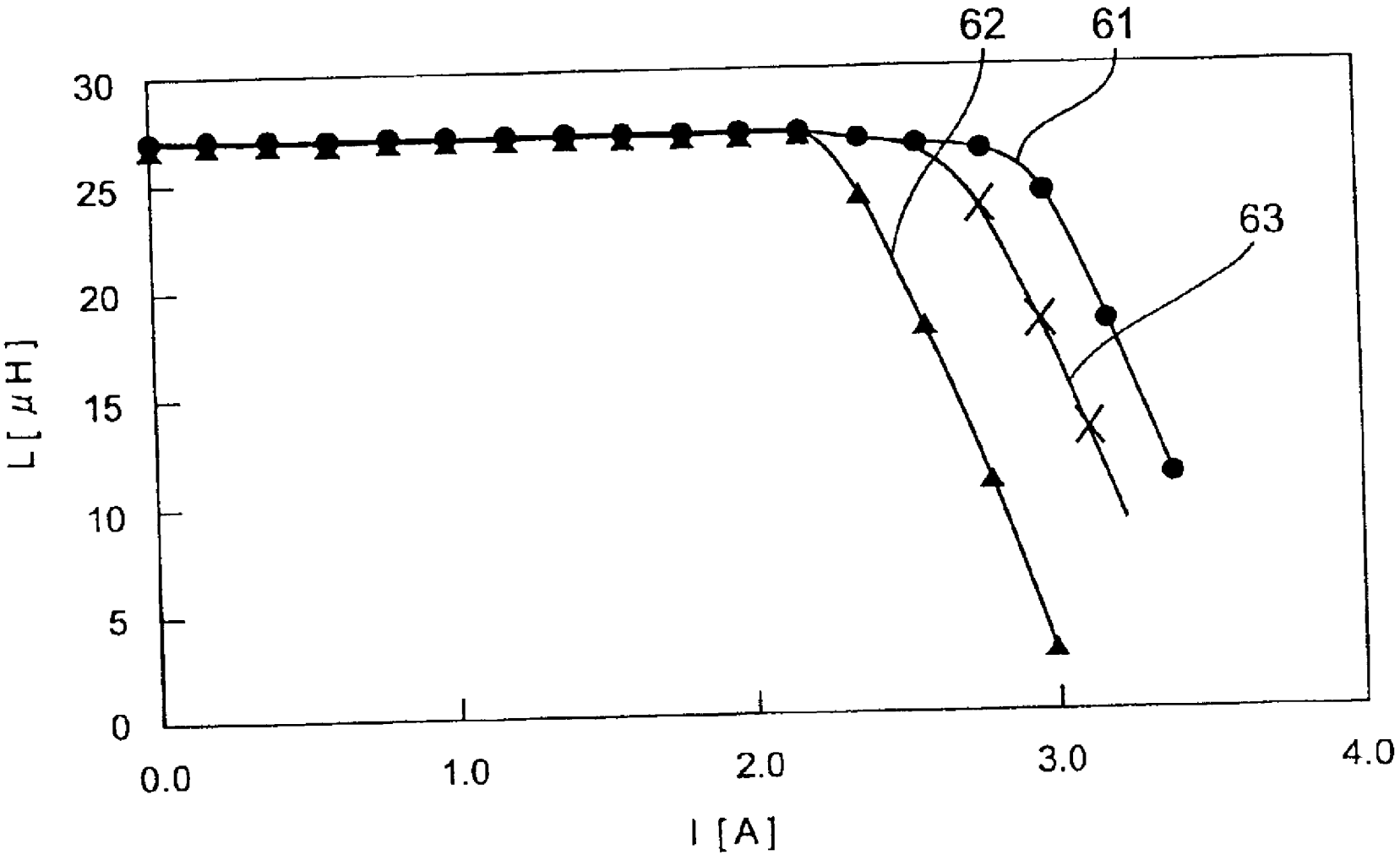
FIG. 6 is a diagram showing the measurement results of the direct current superimposition in the second embodiment.

The coil 25 has 18 turns and has a direct current resistance of 500 mΩ. The bonded magnets 24 are arranged at two places where the hollow core piece 21 and the rod core piece 22 are in contact with each other. The bonded magnet 24 is arranged in order that the direction of the magnetic flux generated by the magnetic field due to the magnet is opposite to the direction of the magnetic flux generated by the magnetic field due to the coil 25. FIG. 6 shows the measurement results of the direct current superimposition.

In FIG. 6, a solid line 61 indicates the case where the bonded magnet 24 is inserted, and a solid line 62 indicates the case where the bonded magnet 24 is not inserted. As is clear from these results, the direct current superimposition is improved by about 35% due to the bonded magnet 24. When irreversible demagnetization due to reflow soldering heat or demagnetization due to oxidation is brought about, the direct current superimposition characteristic becomes as indicated by a solid line 63 shown in FIG. 6.

Figure 4A:
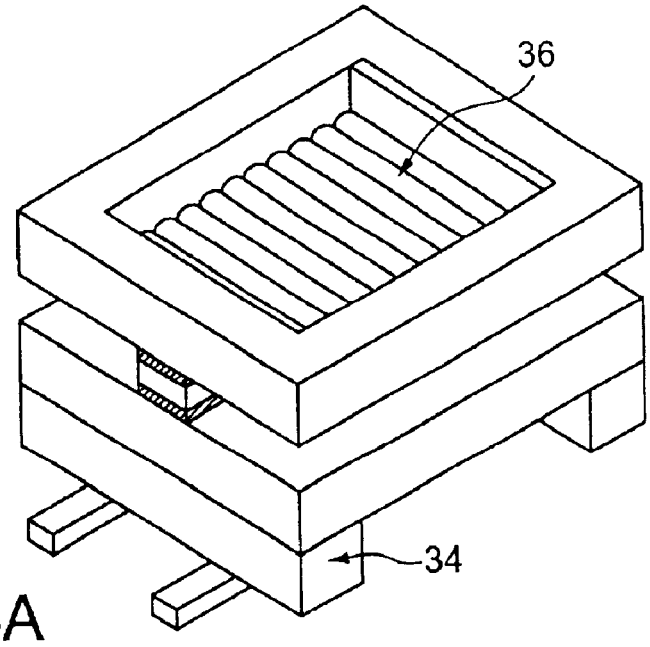
FIG. 4A is a perspective view of the whole according to a third embodiment of the present invention.
Figure 4B:
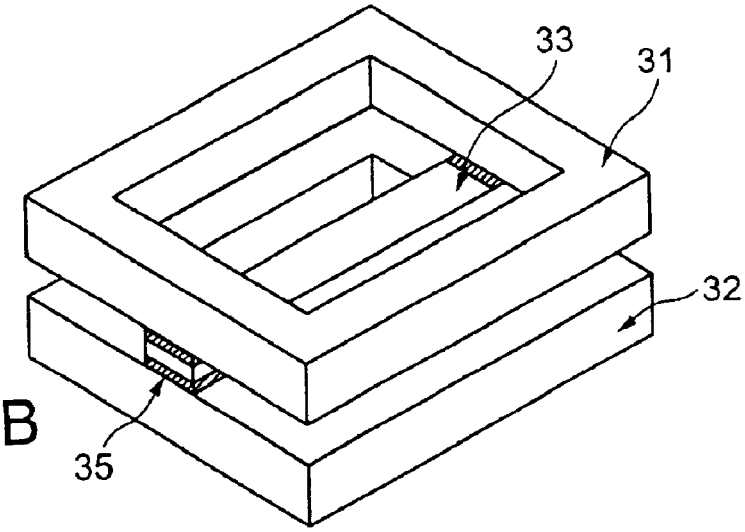
FIG. 4B is a perspective view of a core portion assembled according to the third embodiment of the present invention.
Figure 4C:
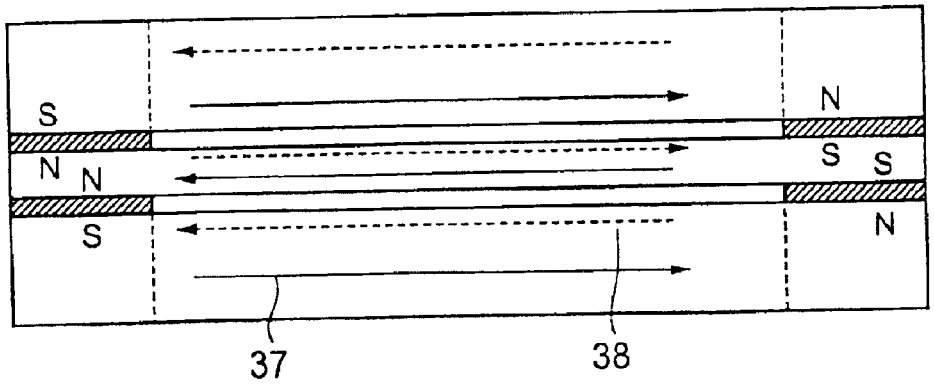
FIG. 4C is a side view of only the core portion shown in FIG. 4B.

An inductor component according to a third embodiment of the present invention will be described below in detail with reference to FIGS. 4A to 4C. FIGS. 4A to 4C show the configuration of the inductor component according to the third embodiment of the present invention. FIG. 4A is a perspective view of an assembly completed. FIG. 4B is a perspective view showing only hollow core pieces and a rod core piece. FIG. 4C is a sectional view of FIG. 4B and shows a magnetic field due to a coil and magnetic fields due to bonded magnets.

The inductor component includes a core composed of hollow core pieces 31 and 32 and a rod core piece 33, a bobbin 34, and bonded magnets 35 as shown in FIG. 4A. The inductor component is assembled in order that the hollow core pieces 31 and 32 hold the rod core piece 33 therebetween. The coil 36 is arranged as shown in FIG. 4A. As shown in FIGS. 4B and 4C, the bonded magnets 35 are inserted into four places in total of top and bottom surfaces of both end portions of the rod core piece where joining is performed between the hollow core pieces 31 and 32 and the rod core piece 33. The assembly assembled as described above is used as an inductor component.

As shown in FIG. 4C, the magnetic flux generated by the magnetic field due to the coil flows in the direction indicated by solid line arrows (reference numeral 38). The magnetic flux generated by the magnetic fields due to the bonded magnets flow in the direction indicated by broken line arrows (reference numeral 37).

Mn—Zn ferrite is used as the material for the hollow core pieces 31 and 32 and rod core piece 33 used in the present embodiment. The magnetic path length is 6.0 cm, and the effective cross-sectional area is 0.1 $cm^2$. The bonded magnets 35 have a shape of 250 $\mu$m in thickness and 0.1 $cm^2$ in cross-sectional area. SmCo is used as the material powder.

The coil 36 has 18 turns and has a direct current resistance of 500 mΩ. The bonded magnets 35 are arranged at four places where the hollow core pieces 31 and 32 and the rod core piece 33 are in contact with each other. The bonded magnet 35 is arranged in order that the direction of the magnetic flux generated by the magnetic field due to the magnet is opposite to the direction of the magnetic flux generated by the magnetic field due to the coil 36.

Regarding the bonded magnets in the aforementioned first to third embodiments, the intrinsic coercive force is desirably 10 KOe or more. The material for the bonded magnet is desirably a resin containing 30% by volume or more of rare-earth magnet powder having Tc of 500° C. or more and having an average particle diameter of 2.5 to 50 $\mu$m, and desirably has a resistivity of 0.1 Ωcm or more. Furthermore, the rare-earth alloy desirably has a composition of $Sm(Cobal.Fe_{0.15\ to\ 0.25}Cu_{0.05\ to\ 0.06}Zr_{0.02\ to\ 0.03})_{7.0\ to\ 8.5}$.

The resin used for the bonded magnet is desirably one selected from the group consisting of a polyimide resin, epoxy resin, poly(phenylene sulfide) resin, silicone resin, polyester resin, aromatic nylon, liquid crystal polymer, and a complex thereof. Preferably, the surface of the rare-earth magnet powder is coated with 0.1 to 10% by volume of at least one selected from the group consisting of Zn, Al, Bi, Ga, In, Mg, Pb, Sb, Sn, and an alloy thereof, or is made to form a complex. The magnet powder is preferably subjected to a surface treatment with a dispersing agent of a silane coupling agent or a titanium coupling agent prior to mixing with the resin.

Superior direct current superimposition characteristic can be achieved when the bonded magnet is made to be anisotropic by magnetic field orientation during manufacture, and the bonded magnet is magnetized at a magnetic field of 2.5 T or more after assembling. In this case, a core can be formed to have a core loss characteristic being unlikely to degrade. Superior direct current superimposition characteristic can be achieved by attaching importance to the intrinsic coercive force rather than the energy product. Therefore, even when a permanent magnet for the use has a high resistivity, sufficiently high direct current superimposition characteristic can be achieved as long as the intrinsic coercive force is high.

In general, a magnet having a high resistivity and high intrinsic coercive force can be achieved by a rare-earth bonded magnet produced by mixing a rare-earth magnet powder with a binder followed by molding the resulting mixture. When the magnet powder has a high coercive force, the magnet powder can produce a magnet having a high intrinsic coercive force regardless of composition. Examples of types of the rare-earth magnet powder include SmCo-base, NdFeB-base, and SmFeN-base. Since the magnet must have Tc of 500° C. or more and have an intrinsic coercive force of 10 KOe or more from the viewpoint of the reflow conditions and oxidation resistance, the magnet is preferably a $Sm_2Co_{17}$-based magnet under present circumstances.

Any material having soft magnetism is effective as the magnetic core in the aforementioned first to third embodiments. In general, MnZn-based or NiZn-based ferrite, dust core, silicon steel, amorphous material, or the like is used.

As described above, according to the present invention, an inductor component can be provided without reduction in bias effect due to ensuring of the clearance in consideration of variations in width of the gap and variations in thickness of the bonded magnet.

In addition, since irreversible demagnetization due to reflow soldering heat and demagnetization due to oxidation can be prevented by using the aforementioned material, further superior direct current superimposition characteristic can be achieved.

What is claimed is:

1. An inductor component having a core comprising:

a hollow core piece; and a rod core piece which is arranged across the hollow core piece;

wherein joining is performed between the hollow core piece and the bottom surfaces of both end portions of the rod core piece with bonded magnets therebetween; and wherein the bonded magnet has a resisivity of 1 Ωcm or more and is formed from a resin; and wherein the resin contains 30% by volume or more or rare-earth magnet powder having a Tc of 500° C. or more and an average particle diameter of 2.5 to 50 μm, has an intrinsic coercive force of 10 KOe or more, and is one selected from the group consisting of a polyimide resin, epoxy resin, poly(phenylene sulfide) resin, silicon resin, polyester resin, aromatic nylon, liquid crystal polymer resin, and a complex thereof.

2. The inductor component claimed in claim 1, wherein a magnet powder of the bonded magnet is subjected to a surface treatment with a dispersing agent of a silane coupling agent or a titanium coupling agent prior to mixing with the resin.

3. The inductor component claimed in claim 2, wherein the hollow core piece and the rod core piece are magnetic core pieces comprising MnZn-based or NiZn-based ferrite, silicon steel, or amorphous material.

* * * * *